US007918237B1

(12) United States Patent
Kuo et al.

(10) Patent No.: US 7,918,237 B1
(45) Date of Patent: Apr. 5, 2011

(54) CRUTCH WITH LENGTH CONTROLLABLE BY PRESSURE SENSING AND LENGTH CONTROLLING METHOD THEREOF

(75) Inventors: Yau-Hwang Kuo, Tainan (TW); KuanRong Lee, Chiayi (TW); Cheng-Yi Chien, Taichung (TW); Ming-Tang Liu, Tainan County (TW); Chi-Lu Yang, Tainan County (TW)

(73) Assignee: Institute for Information Industry, Taipei (TW)

( * ) Notice: Subject to any disclaimer, the term of this patent is extended or adjusted under 35 U.S.C. 154(b) by 0 days.

(21) Appl. No.: 12/635,387

(22) Filed: Dec. 10, 2009

(30) Foreign Application Priority Data

Nov. 13, 2009 (TW) ..... 98138568 A

(51) Int. Cl.
*A45B 9/00* (2006.01)

(52) U.S. Cl. ..... 135/65; 135/66; 135/75

(58) Field of Classification Search ..... 135/65, 135/66, 75
See application file for complete search history.

(56) References Cited

U.S. PATENT DOCUMENTS

| | | | | |
|---|---|---|---|---|
| 3,157,188 | A * | 11/1964 | Farnham | 135/69 |
| 3,157,189 | A * | 11/1964 | Farnham | 135/69 |
| 3,416,546 | A * | 12/1968 | Carpenter | 135/68 |
| 4,252,137 | A * | 2/1981 | Cohen | 135/69 |
| 4,601,302 | A * | 7/1986 | Breen et al. | 135/66 |
| 5,282,486 | A * | 2/1994 | Hoover | 135/69 |
| 7,350,531 | B2 * | 4/2008 | Coe | 135/69 |
| 2008/0257392 | A1 * | 10/2008 | Stricevic | 135/66 |

* cited by examiner

*Primary Examiner* — David Dunn
*Assistant Examiner* — Noah Chandler Hawk
(74) *Attorney, Agent, or Firm* — Muncy, Geissler, Olds & Lowe, PLLC

(57) ABSTRACT

A crutch with a length controllable by pressure sensing and a method thereof are provided. The crutch includes a holding portion, a lead screw shaft, a rod body, a control module, and a supporting portion. The holding portion and the supporting portion have a plurality of pressure sensing units, for generating holding pressure values and feedback pressure values. The rod body is connected to the holding portion, a motor is arranged on the supporting portion, and the lead screw shaft has one end engaged to the motor and the other end pivoted to the rod body. When the holding portion determines that the holding portion is held according to the holding pressure values and the feedback pressure values, and that the crutch is oblique, the motor is enabled to rotate to drive the lead screw shaft to pivotally rotate, thereby shortening or prolonging the length of the crutch.

8 Claims, 15 Drawing Sheets

CRUTCH WITH LENGTH CONTROLLABLE BY PRESSURE SENSING AND LENGTH CONTROLLING METHOD THEREOF

CROSS-REFERENCE TO RELATED APPLICATION

This application claims the benefit of Taiwan Patent Application No. 098138568, filed on Nov. 13, 2009, which is hereby incorporated by reference for all purposes as if fully set forth herein.

BACKGROUND OF THE INVENTION

1. Field of the Invention

The present invention relates to a crutch with an adjustable length and a length adjusting method thereof, and more particularly to a crutch with a length adjustable according to the feedback pressure values of the crutch contacting with the ground, and a length adjusting method thereof.

2. Related Art

FIG. 1A is a diagram of a single-leg retractable crutch in the prior art, and FIG. 1B is a diagram of a multi-leg retractable crutch in the prior art. Referring to FIGS. 1A and 1B, in the prior art, the crutch excellently assists the people who has difficulty in moving to walk. The crutch in the early stage is mostly a single-leg crutch 1. In order to be conveniently accommodated and carried by a user, the manufacturer develops the multi-section single-leg crutch 1, which is formed by serially connecting cylinders 11 having different apertures, capable of extending or retracting to adjust a length of the single-leg crutch 1. Further, the single-leg crutch 1 has a catch structure, such that the single-leg crutch 1 is fixed on the appropriate length for the user after being adjusted. However, the single-leg crutch 1 contacts with the ground only by a single leg 12, so the user needs to spend much strength in maintaining the upstanding operation of the single-leg crutch 1, and the user gets more inconveniences on the force application. Therefore, the manufacturer develops a multi-leg retractable crutch 2 as shown in FIG. 1B, in which a base 22 provided with a plurality of legs is used to assist the crutch to be upstanding on the ground. However, the multi-leg retractable crutch 2 still has some inconvenience. For seek of convenience in design and in order to save the cost, each section 21 of the multi-leg retractable crutch 2 is designed in a standardization manner, such that a length of each section 21 is fixed, so the mode of adjusting the length of the multi-leg retractable crutch 2 is fixed, and the appropriate height for the user may not be certainly obtained through adjustment. Thus, after the length of the multi-leg retractable crutch 2 is adjusted, the length may be too high or too low for the user. In addition, when the user walks on a path having a slope change, force application modes on the multi-leg retractable crutch 2 by the user are different, when the path is an upslope, the length of the multi-leg retractable crutch 2 intends to be too long, and when the path is a downslope, the length of the multi-leg retractable crutch 2 intends to be too short. For the user, once the slope is changed, the length of the crutch needs to be adjusted correspondly, which is quite inconvenient in using.

Therefore, it is a topic to be considered by the manufacturers how to provide a crutch adapted to various path slope changes.

SUMMARY OF THE INVENTION

The present invention is directed to a crutch with a length adjustable to an appropriate height for a user in response to slope change and a crutch length adjusting method.

The present invention provides a crutch with a length controllable by pressure sensing, which includes a holding portion, a lead screw shaft, a supporting portion, a rod body, and a control module. The holding portion has at least one holding pressure sensing unit, for generating at least one holding pressure value. The lead screw shaft is perpendicular to the supporting portion, and has an engaging portion and a screwing portion respectively on two ends of the lead screw shaft. The supporting portion includes a plurality of supporting pressure sensing units and a motor. The supporting pressure sensing units are used to sense a pressure for the supporting portion contacting with the ground, so as to generate a plurality of feedback pressure values. The motor is engaged to the engaging portion, so as to drive the lead screw shaft to pivotally rotate. The rod body has two ends respectively connected to the holding portion and the screwing portion of the lead screw shaft, and allows the lead screw shaft to pivotally rotate inward or outward from the rod body, thereby prolonging or shortening the entire length of the crutch. The control module is electrically coupled to the holding pressure sensing units, the supporting pressure sensing units, and the motor, and controls the rotation of the motor according to the holding pressure values and the feedback pressure values.

The crutch according to the present invention further includes a level meter, electrically coupled to the control module for generating an oblique angle value, and the control module controls a rotating direction of the motor according to the holding pressure values, the feedback pressure values, and the oblique angle value.

The present invention provides a length controlling method by pressure sensing, which is applicable to a crutch, and includes the following steps. A holding strength of a holding portion of the crutch is sensed by utilizing at least one holding pressure sensing unit, so as to obtain at least one holding pressure value. A pressure for a supporting portion of the crutch contacting with the ground is sensed by utilizing a plurality of supporting pressure sensing units, so as to obtain a plurality of feedback pressure values. The holding pressure values and the feedback pressure values are analyzed by utilizing a control module, so as to determine an oblique direction of the crutch. Finally, the length of the crutch is adjusted according to the oblique direction of the crutch.

The present invention provides a length controlling method by pressure sensing, which is applicable to a crutch, and includes the following steps. A holding strength of a holding portion of the crutch is sensed by utilizing at least one holding pressure sensing units, so as to obtain at least one holding pressure values. A pressure for a supporting portion of the crutch contacting with the ground is sensed by utilizing a plurality of supporting pressure sensing units, so as to obtain a plurality of feedback pressure values. An oblique angle value of the crutch is calculated by utilizing a level meter. The holding pressure values, the feedback pressure values, and the oblique angle are analyzed by utilizing a control module, so as to determine an oblique direction of the crutch. Finally, the length of the crutch is adjusted according to the oblique direction of the crutch.

In the present invention, it is determined whether the crutch is used or not according to the holding pressure values, the change of the pressure for the legs of the crutch contacting with the ground is determined according to the feedback pressure values, and it is determined whether the crutch entirely contacts with the ground or not. Further, a slope of a waking path of the user is determined according to the feedback pressure values, and the control module adjusts the length of the crutch according to the change in response to the slope change of the walking path of the user. In addition, the crutch further has a level meter arranged thereon, for directly determining the slope change of the walking path of the user, so as to determine whether the path is an upslope, a downslope, or a flat ground, thereby simplifying a process of determining the slope by the control module. The control module only needs to determine the slope of the walking path of the user according to the feedback pressure values, so as to calculate an appropriate length change value of the crutch, thereby adjusting the length of the crutch. Through the movement of the lead screw shaft and the rod body, the crutch may more precisely adjust the length according to the user's habit of using the crutch and the length of the crutch favored by the user.

BRIEF DESCRIPTION OF THE DRAWINGS

The present invention will become more fully understood from the detailed description given herein below for illustration only, and thus are not limitative of the present invention, and wherein.

DETAILED DESCRIPTION OF THE INVENTION

Preferred embodiments of the present invention are described in detail with reference to accompanying drawings.

Figure 1A:
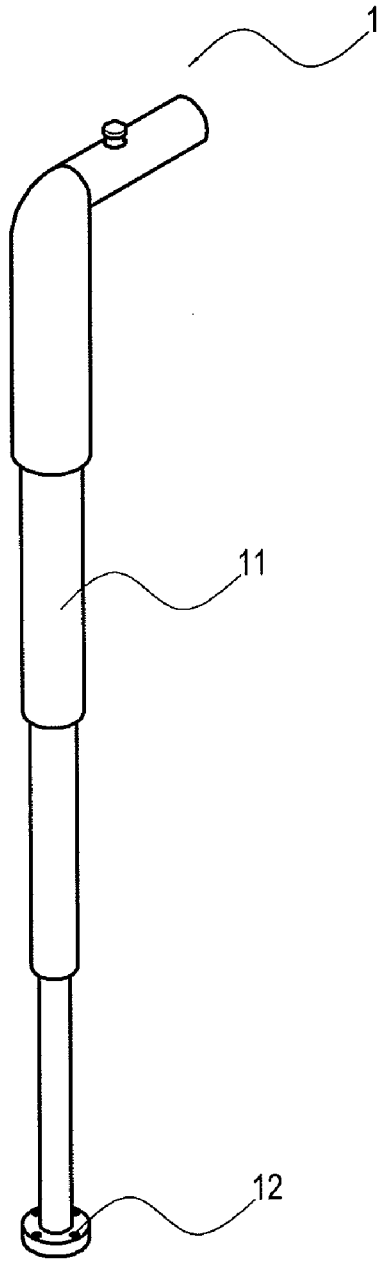
FIG. 1A (Prior art)
FIG. 1A is a diagram of a single-leg retractable crutch in the prior art.
Figure 1B:
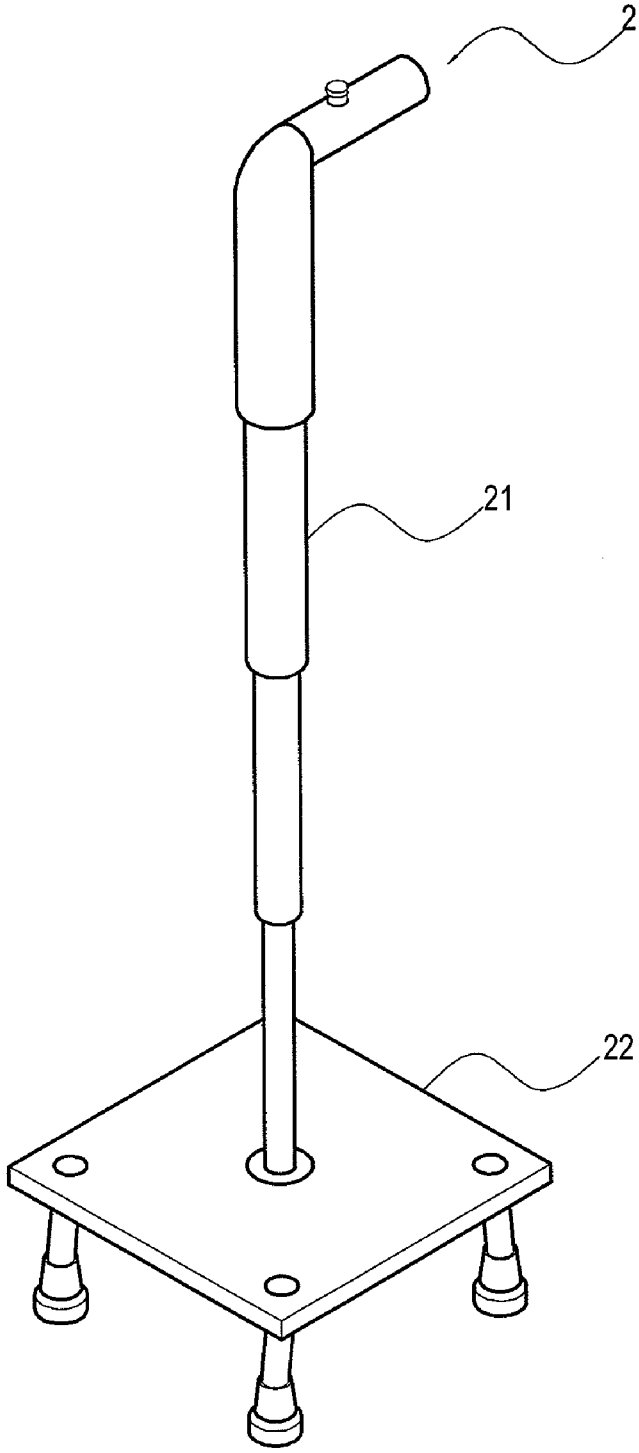
FIG. 1B (Prior art)
FIG. 1B is a diagram of a multi-leg retractable crutch in the prior art.
Figure 2A:
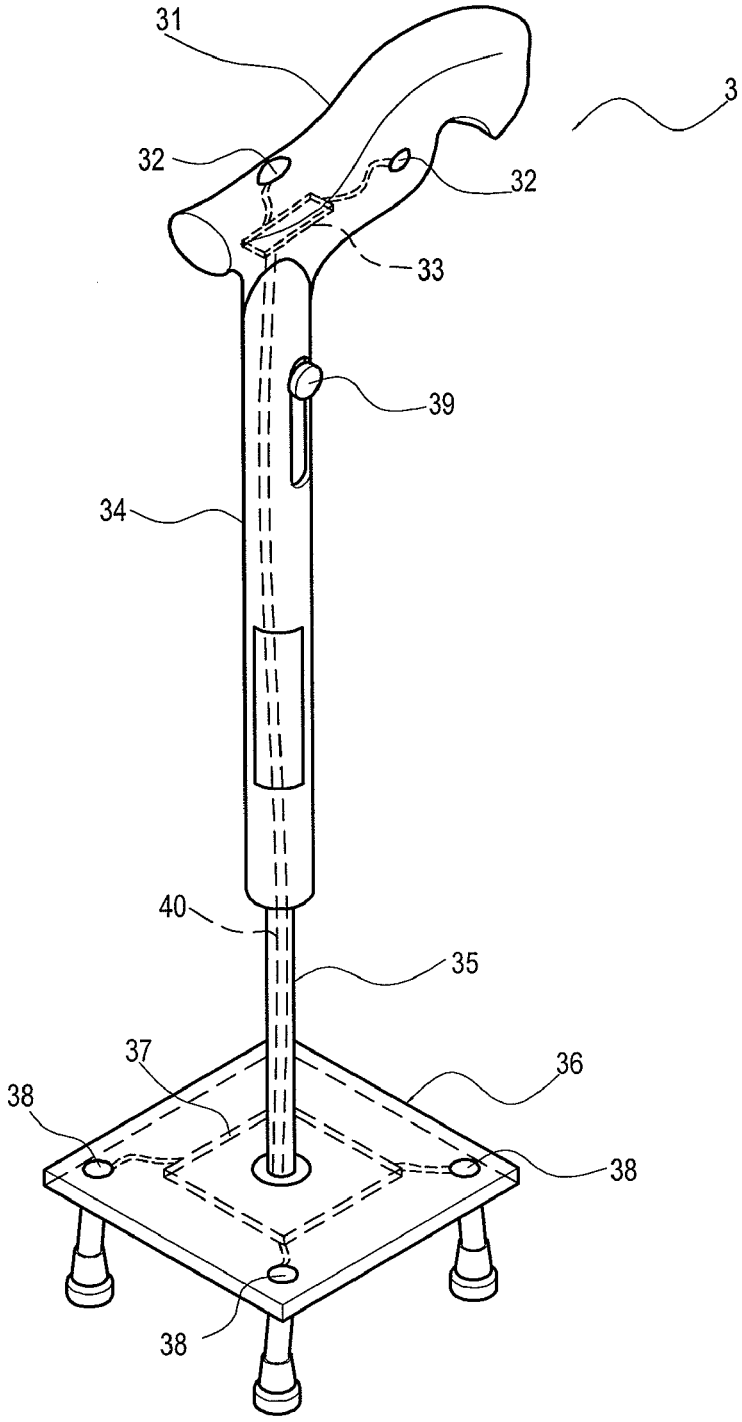
FIG. 2A is a structural view of a crutch according to one embodiment of the present invention.
Figure 2B:
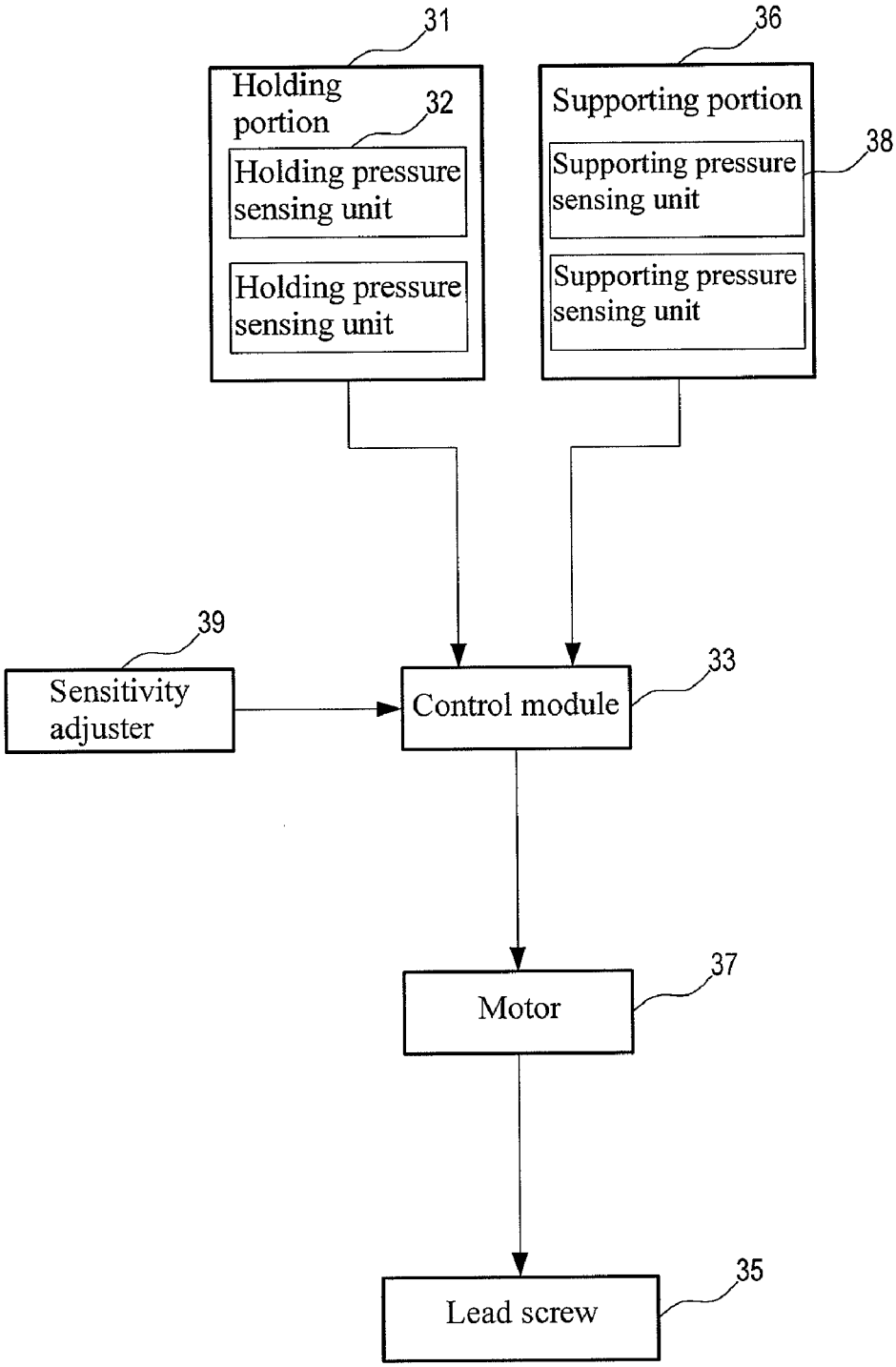
FIG. 2B is a block diagram of the crutch according to one embodiment of the present invention.
Figure 2C:
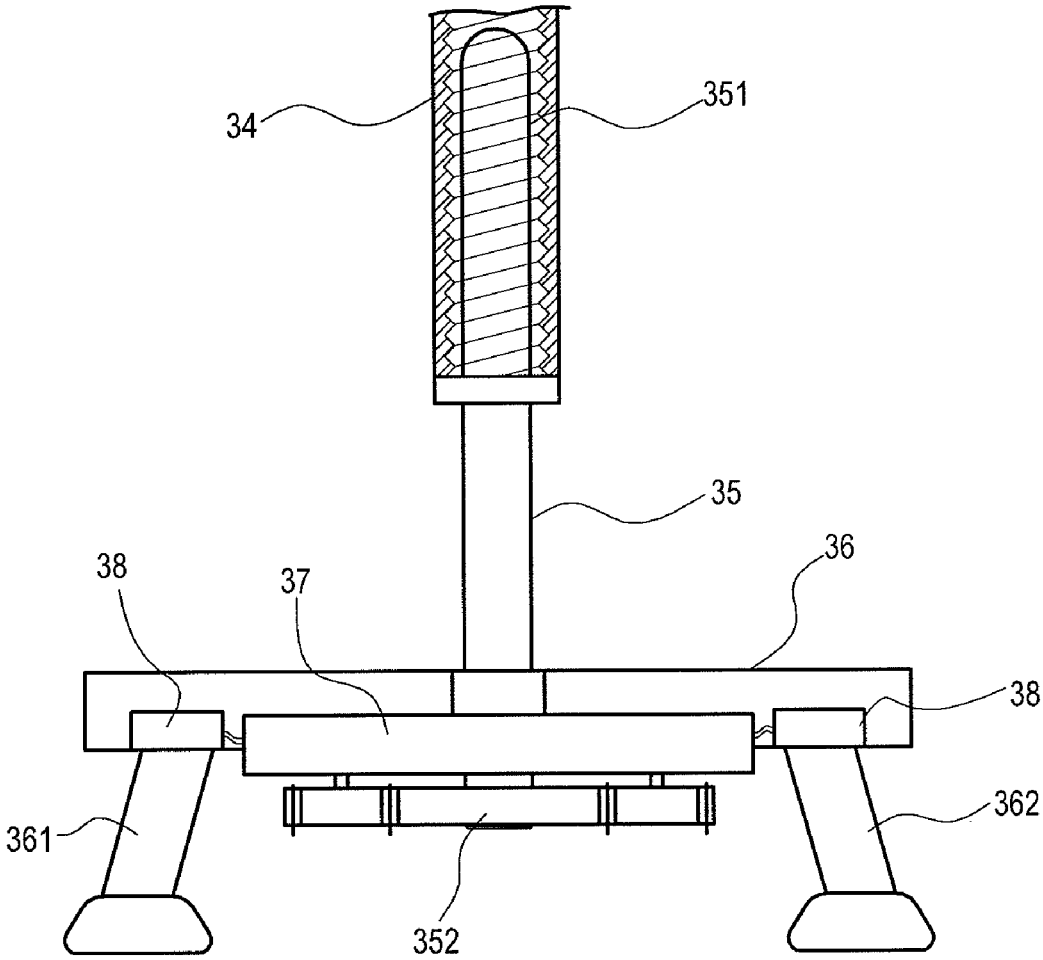
FIG. 2C is a partial structural view of the crutch according to one embodiment of the present invention.

FIG. 2A is a structural view of a crutch according to one embodiment of the present invention, FIG. 2B is a block diagram of the crutch according to the embodiment of the present invention, and FIG. 2C is a partial structural view of the crutch according to the embodiment of the present invention. Referring to FIGS. 2A, 2B, and 2C, in this embodiment, the crutch 3 includes a holding portion 31, a lead screw shaft 35, a supporting portion 36, a rod body 34, and a control module 33.

The holding portion 31 is of a T shape, an arc line shape, or an L shape, and has at least one holding pressure sensing unit 32 arranged thereon. One end of the rod body 34 is connected to the holding portion 31, the other end has a screw hole opened therein, and a screw thread is provided in the screw hole. Two ends of the lead screw shaft 35 respectively include an engaging portion 352 and a screwing portion 351, and the screwing portion 351 has a screw thread, for screwing into the screw hole, such that the lead screw shaft 35 and the rod body 34 are pivoted to each other. The supporting portion 36 includes a plurality of supporting pressure sensing units 38 and a motor 37, each leg of the supporting portion 36 has at least one pressure sensing unit 38, the motor 37 is arranged on the supporting portion 36 and is engaged to the engaging portion 352 of the lead screw shaft 35, and the lead screw shaft 35 is upstanding on the supporting portion 36.

The control module 33 is arranged on the crutch 3, and an arrangement position thereof may be any one of the holding portion 31, the rod body 34, and the supporting portion 36, but the present invention is not limited here. In this embodiment, the control module 33 is arranged on the holding portion 31 for description.

Figure 2D:
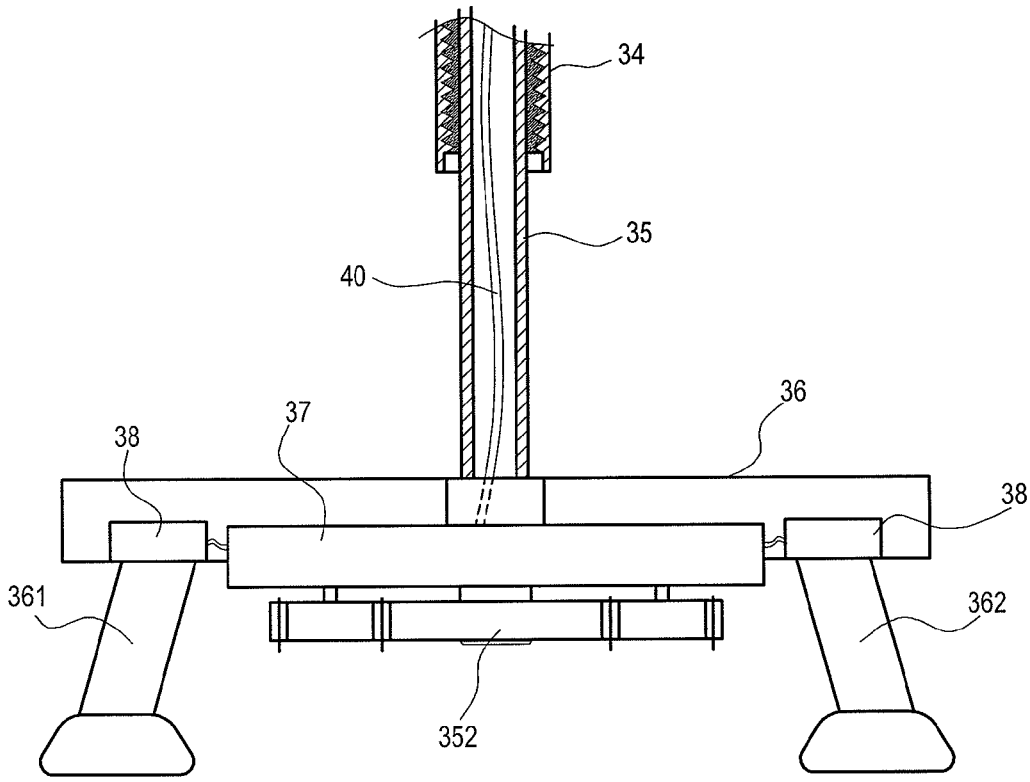
FIG. 2D is a structural view of a rod body of the crutch according to one embodiment of the present invention.

FIG. 2D is a structural view of the rod body 34 of the crutch according to one embodiment of the present invention. Referring to FIG. 2D, in this embodiment, the rod body 34 and the lead screw shaft 35 of the crutch 3 are hollow pipes, and a plurality of wires 40 pass through the rod body 34 and the lead screw shaft 35. The control module 33 is electrically coupled to the holding pressure sensing units 32, the supporting pressure sensing units 38, and the motor 37 through the wires 40. However, the present invention is not limited here, the wires 40 may be exposed out of the crutch 3, or the control module 33 transmits data with the holding pressure sensing units 32, the supporting pressure sensing units 38, and the motor 37 in a wireless or other communication manners.

Figure 3A:
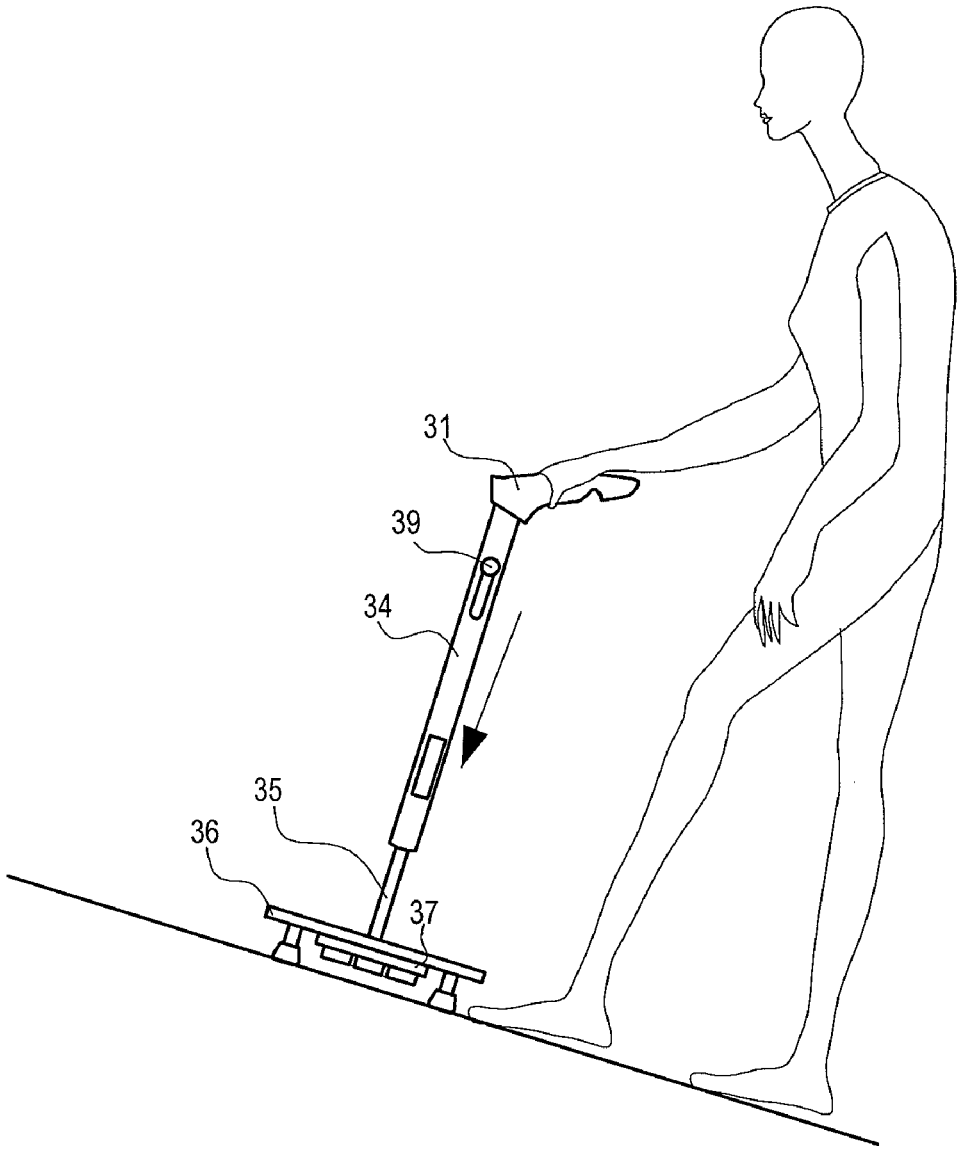
FIG. 3A is a diagram of a user using the crutch and walking on an upslope according to one embodiment of the present invention.
Figure 3B:
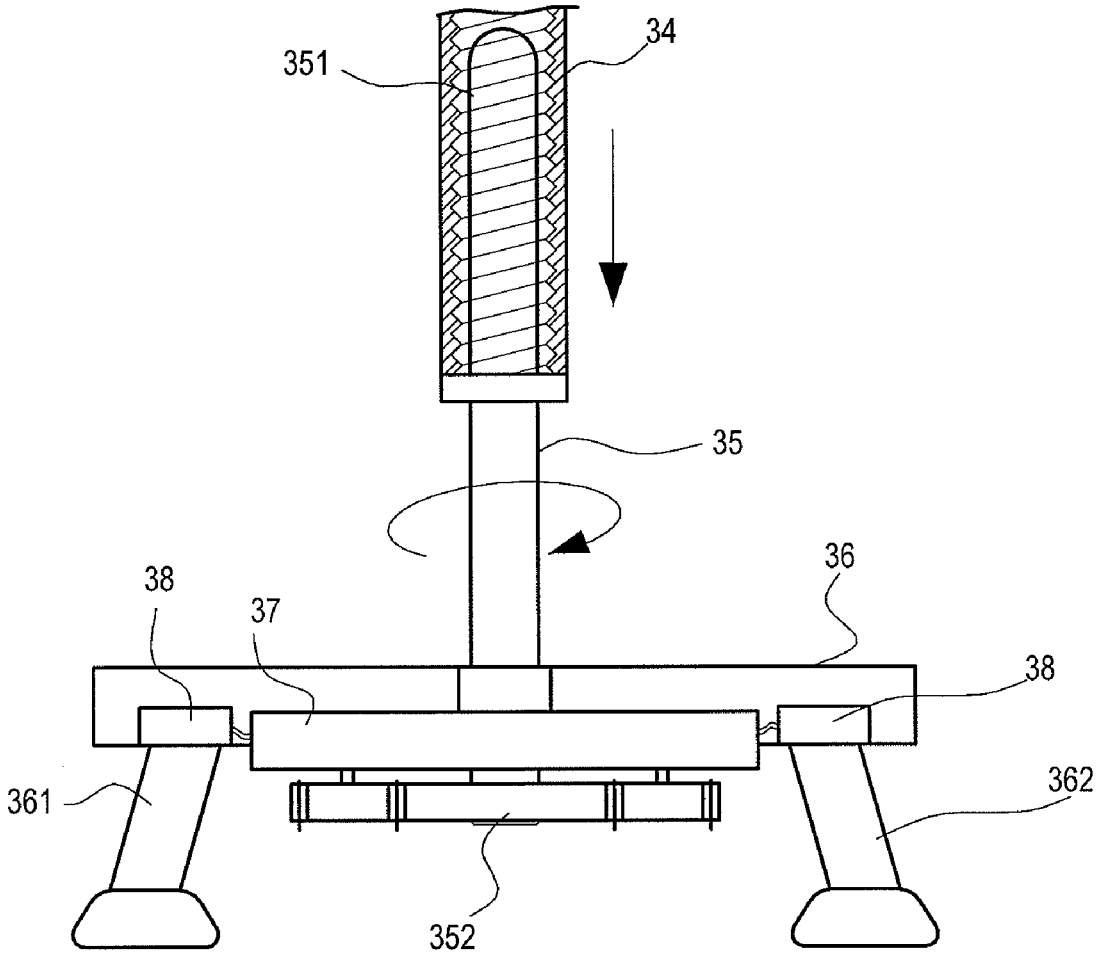
FIG. 3B is a diagram in which the crutch is shortened according to one embodiment of the present invention.
Figure 3C:
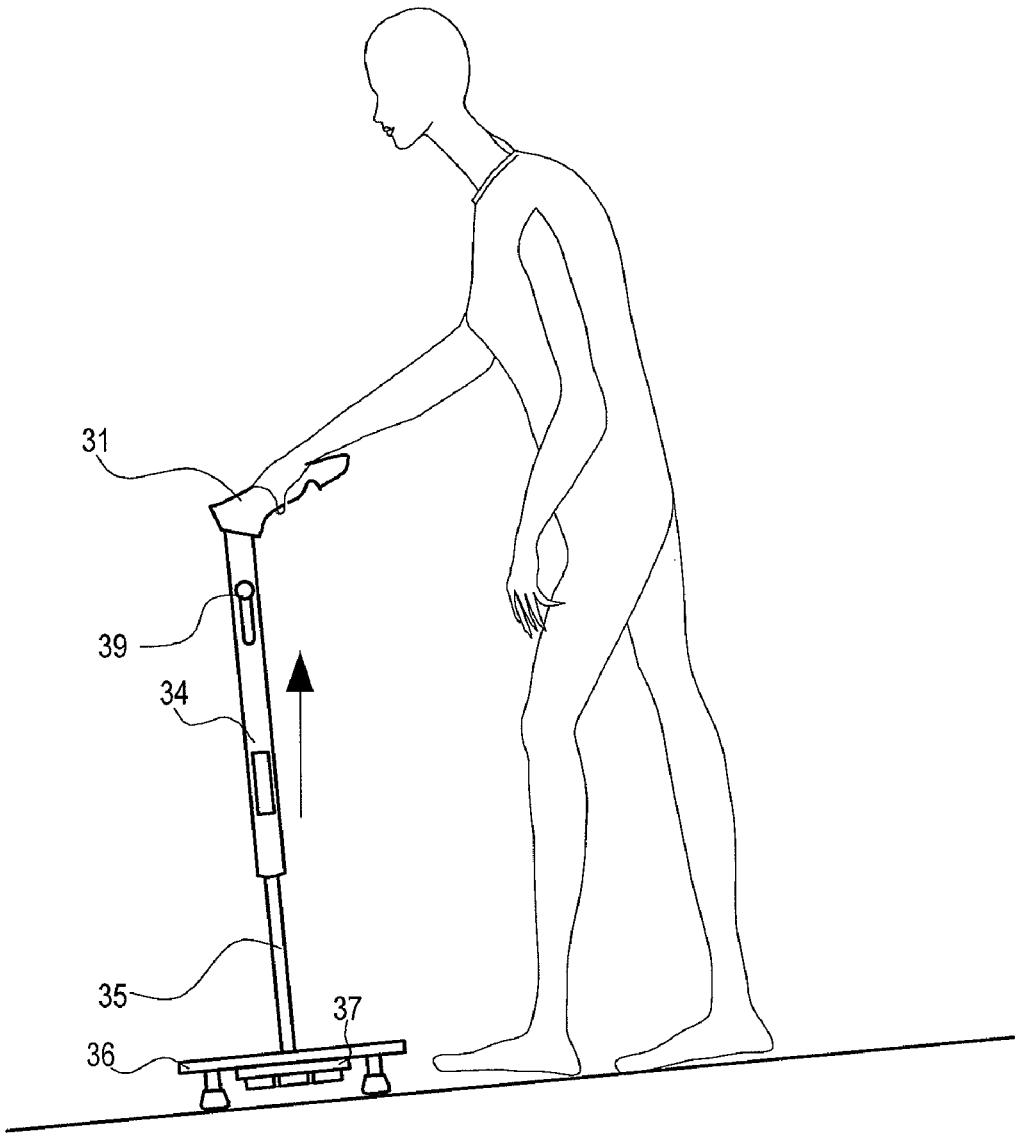
FIG. 3C is a diagram of a user using the crutch and walking on a downslope according to one embodiment of the present invention.
Figure 3D:
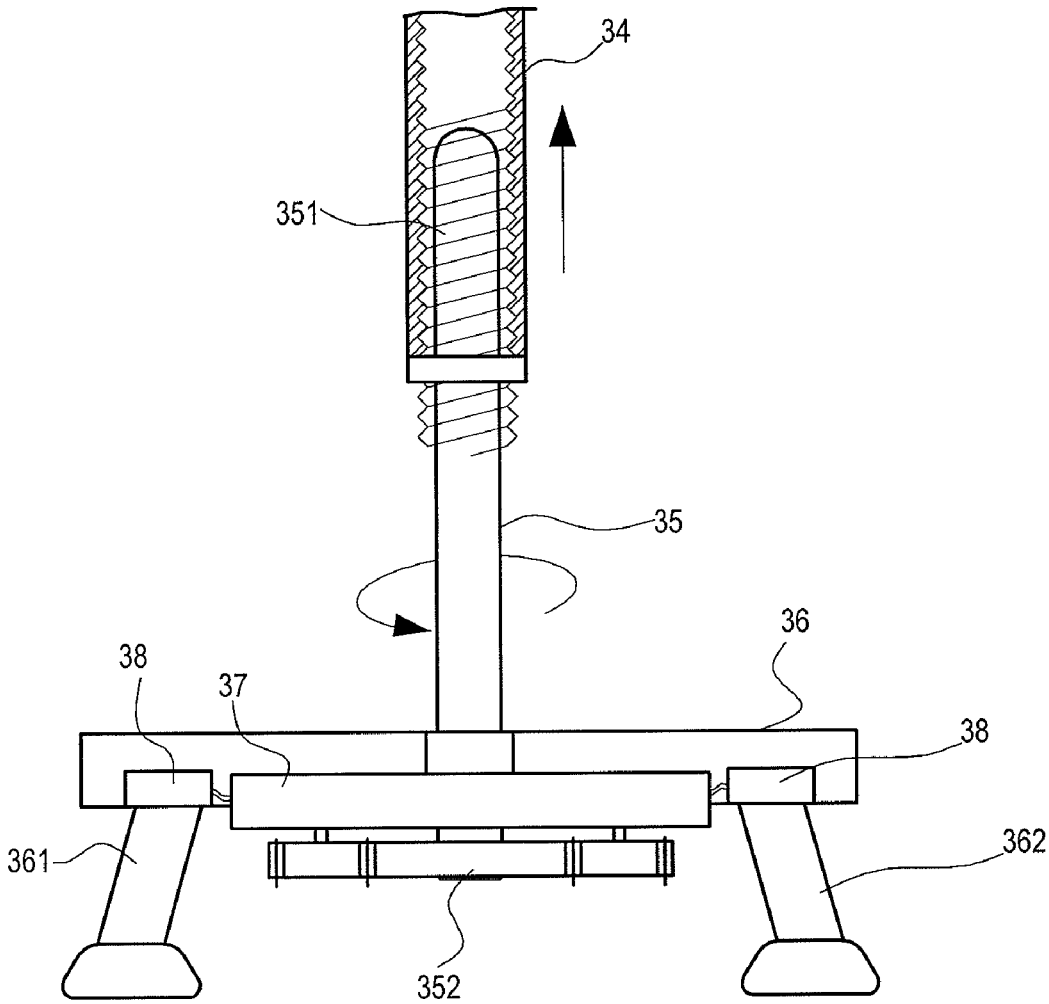
FIG. 3D is a diagram in which the crutch is prolonged according to one embodiment of the present invention.
Figure 3E:
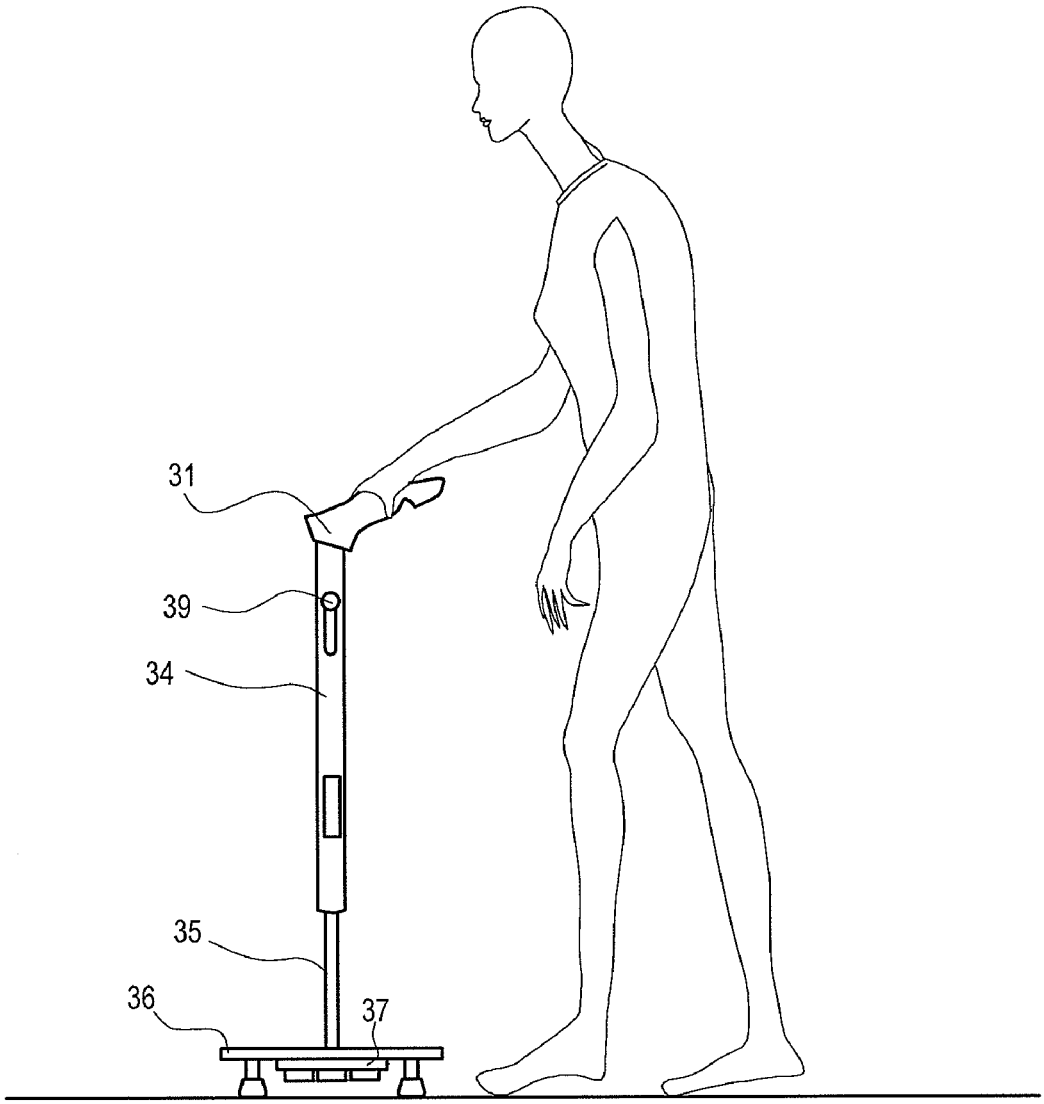
FIG. 3E is a diagram of a user using the crutch and walking on a flat ground according to one embodiment of the present invention.

FIG. 3A is a diagram of a user using the crutch and walking on an upslope according to one embodiment of the present invention, FIG. 3B is a diagram in which the crutch is shortened according to one embodiment of the present invention, FIG. 3C is a diagram of a user using the crutch and walking on a downslope according to one embodiment of the present invention, FIG. 3D is a diagram in which the crutch is prolonged according to one embodiment of the present invention, and FIG. 3E is a diagram of a user using the crutch and walking on a flat ground according to one embodiment of the present invention. Referring to FIGS. 3A, 3B, 3C, 3D, and 3E, in the embodiment, each holding pressure sensing unit 32 senses a holding strength of the holding portion 31, so as to generate more than one holding pressure values, and the holding pressure values are transmitted to the control module 33. Each supporting pressure sensing unit 38 is used to sense a pressure for the supporting portion 36 contacting with the ground, that is, when all the legs contact with the ground, the legs generate different stresses, and the supporting pressure sensing units 38 sense the stresses, so as to generate a plurality of feedback pressure values, and the feedback pressure values are transmitted to the control module 33. The supporting portion 36 includes at least one front leg 361 and at least one rear leg 362, and the supporting pressure sensing units 38 are respectively arranged on the front leg 361 and the rear leg 362. The feedback pressure values include a front feedback pressure value obtained when the front leg 361 leans against the ground and a rear feedback pressure value obtained when the rear leg 362 leans against the ground.

The control module 33 determines whether the holding portion 31 is held or not by analyzing the at least one holding pressure value. When it is determined that the holding portion 31 is held, the control module 33 determines whether the supporting portion 36 surely contacts with the ground or not by analyzing the feedback pressure values, that is, whether all the legs contact with the ground or not. When it is determined that the supporting portion 36 surely contacts with the ground, the control module 33 analyzes whether a strength for the front leg 361 contacting with the ground is larger than a strength for the rear leg 362 contacting with the ground or not according to the difference of the front feedback pressure value and the rear feedback pressure value, thereby determining whether the crutch 3 is oblique forwards or oblique backwards.

As shown in FIGS. 3A and 3B, when the control module 33 determines that the front feedback pressure value is higher than the rear feedback pressure value and exceeds a critical value, the holding pressure sensing units 32 respectively obtain the holding pressure values, and all the legs contact with the ground. Therefore, the control module 33 determines that the holding portion 31 is held and the crutch 3 is oblique forwards, and the control module 33 controls the motor 37 to rotate, thereby driving the lead screw shaft 35 to pivotally rotate. The supporting portion 36 cannot rotate under a resistance as all the legs contact with the ground, and the rod body 34 cannot pivotally rotate as the holding portion 31 is held by the user, so the lead screw shaft 35 is increasingly screwed into the rod body 34 as the lead screw shaft 35 pivotally rotates, such that the lead screw shaft 35 can pivotally rotate inward the rod body 34, thereby shortening a length of the crutch 3.

As shown in FIGS. 3C and 3D, on the contrary, when the control module 33 determines that the front feedback pressure value is lower than the rear feedback pressure value and exceeds a critical value, the holding pressure sensing units 32 respectively obtain the holding pressure values, and all the legs contact with the ground. Therefore, the control module 33 determines that the holding portion 31 is held and the crutch 3 is oblique backwards, the control module 33 controls the motor 37 to rotate, thereby driving the lead screw shaft 35 to pivotally rotate. The supporting portion 36 cannot rotate under a resistance as all the legs contact with the ground, and the rod body 34 cannot pivotally rotate as the holding portion 31 is held by the user, so the lead screw shaft 35 is increasingly screwed out from the rod body 34 as the lead screw shaft 35 pivotally rotates, such that the lead screw shaft 35 can pivotally rotate outward from the rod body 34, thereby prolonging the length of the crutch 3.

As shown in FIG. 3E, when the control module 33 determines that a difference between the front feedback pressure value and the rear feedback pressure value does not exceed the critical value, the holding pressure sensing units 32 respectively obtain the holding pressure values, and all the legs contact with the ground. The control module 33 determines that the holding portion 31 is held and the crutch 3 is not oblique, such that the control module 33 does not operate.

Figure 4A:
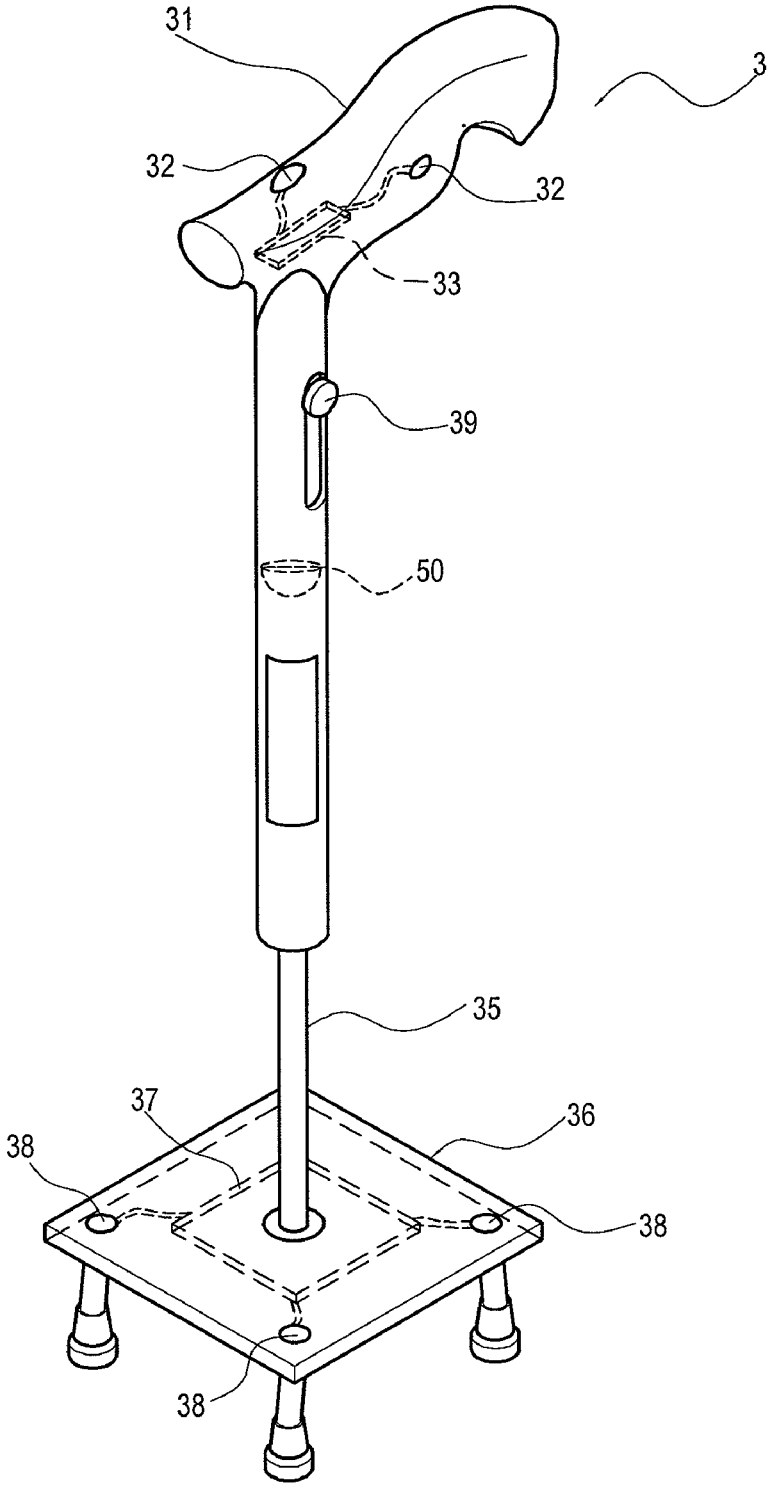
FIG. 4A is a structural view of a crutch according to another embodiment of the present invention.
Figure 4B:
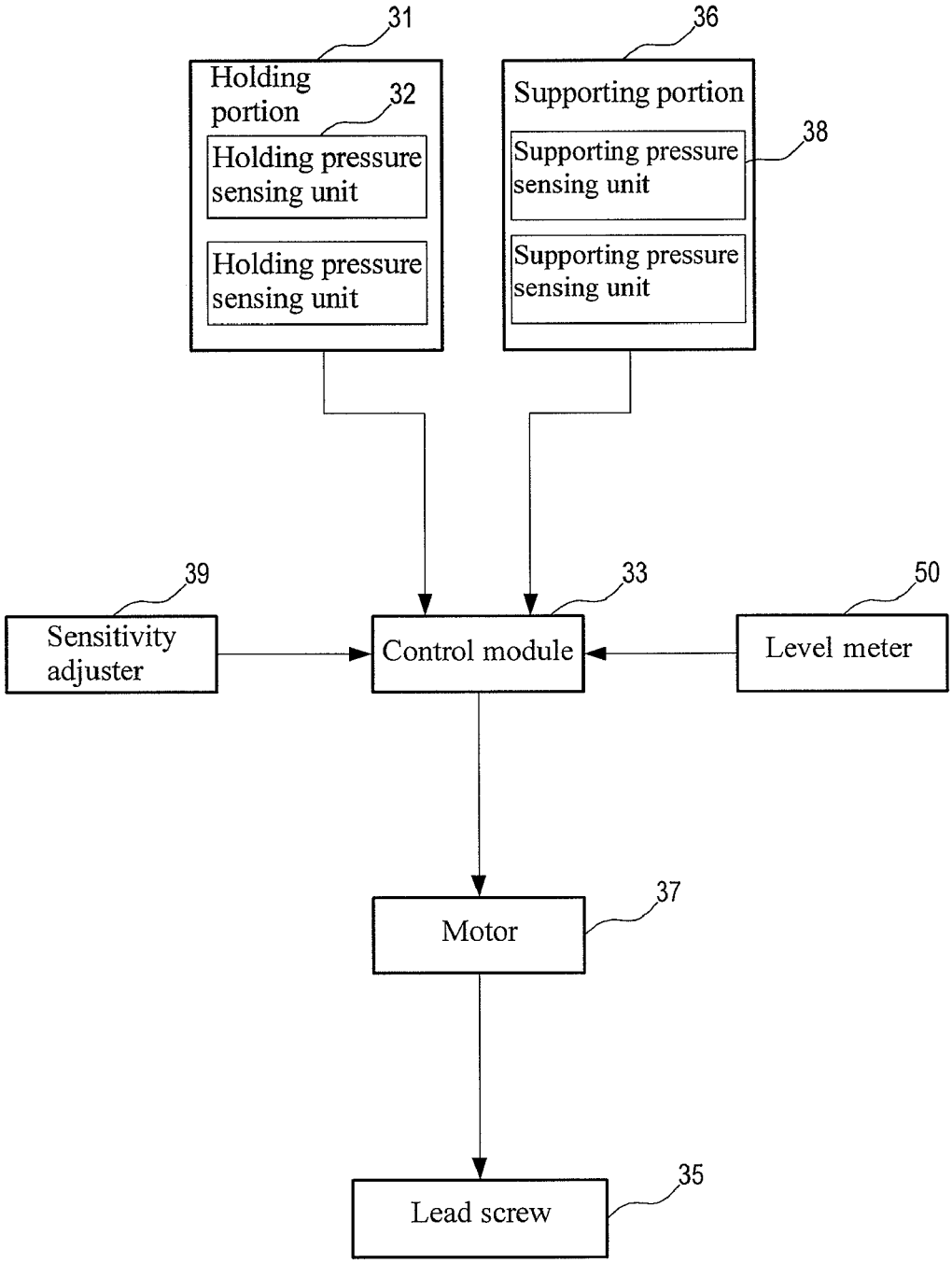
FIG. 4B is a block diagram of the crutch according to another embodiment of the present invention.

FIG. 4A is a structural view of a crutch according to another embodiment of the present invention, and FIG. 4B is a block diagram of the crutch according to another embodiment of the present invention. Referring to FIGS. 4A and 4B, a difference between this embodiment and the embodiment of the crutch as shown in FIGS. 2A and 2B is that the crutch of this embodiment further includes a level meter 50. The level meter 50 is electrically coupled to the control module 33, and is used for generating an oblique angle value.

The control module 33 determines whether the holding portion 31 is held or not by analyzing the holding pressure values. When it is determined that the holding portion 31 is held, the control module 33 determines whether the supporting portion 36 surely contacts with the ground or not by analyzing the feedback pressure values, that is, whether all the legs contact with the ground or not. When it is determined that the supporting portion 36 surely contacts with the ground, the control module 33 determines whether the crutch 3 is oblique forwards or oblique backwards according to the oblique angle value, and then analyzes the difference between the front feedback pressure value and the rear feedback pressure value, thereby calculating the length of the crutch 3 that should be adjusted.

As shown in FIGS. 3A and 3B, when the control module 33 determines that the holding pressure sensing units 32 respectively obtain the holding pressure values, all the legs contact with the ground, and the crutch 3 is oblique forwards, the control module 33 calculates the length of the crutch 3 that should be adjusted according to the difference between the front feedback pressure value and the rear feedback pressure value, and then controls the motor 37 to rotate to drive the lead screw shaft 35 to pivotally rotate. The supporting portion 36 cannot rotate under a resistance as all the legs contact with the ground, and the rod body 34 cannot pivotally rotate as the holding portion 31 is held by the user, so the lead screw shaft 35 is increasingly screwed into the rod body 34 as the lead screw shaft 35 pivotally rotates, such that the lead screw shaft 35 can pivotally rotate inward the rod body 34, thereby shortening a length of the crutch 3 to satisfy the length of the crutch 3 that should be adjusted calculated by the control module 33.

As shown in FIGS. 3C and 3D, on the contrary, when the control module 33 determines that the holding pressure sensing units 32 respectively obtain the holding pressure values, all the legs contact with the ground, and the crutch 3 is oblique backwards, the control module 33 calculates the length of the crutch 3 that should be adjusted according to the difference between the front feedback pressure value and the rear feedback pressure value, and then controls the motor 37 to rotate to drive the lead screw shaft 35 to pivotally rotate. The supporting portion 36 cannot rotate under a resistance as all the legs contact with the ground, and the rod body 34 cannot pivotally rotate as the holding portion 31 is held by the user, so the lead screw shaft 35 is increasingly screwed out from the rod body 34 as the lead screw shaft 35 pivotally rotates, such that the lead screw shaft 35 can pivotally rotate outward from the rod body 34, thereby prolonging a length of the crutch 3 to satisfy the length of the crutch 3 that should be adjusted calculated by the control module 33.

In addition, the crutch 3 further has a sensitivity adjuster 39 arranged thereon, for adjusting a pivotally-rotating unit of the lead screw shaft 35 driven by the motor 37. For example, each time the lead screw shaft 35 pivotally rotates for 1 turn, the relative movement between the lead screw shaft 35 and the rod body 34 is changed by 1 centimeter (cm). The sensitivity adjuster 39 orders the control module 33 to adjust a length unit, for example, each time the lead screw shaft 35 pivotally rotates for 2 turns, the length unit is 2 cm, or each time the lead screw shaft 35 pivotally rotates for 1.5 turns, the length unit is 1.5 cm, and so on, but the present invention is not limited here.

Figure 5A:
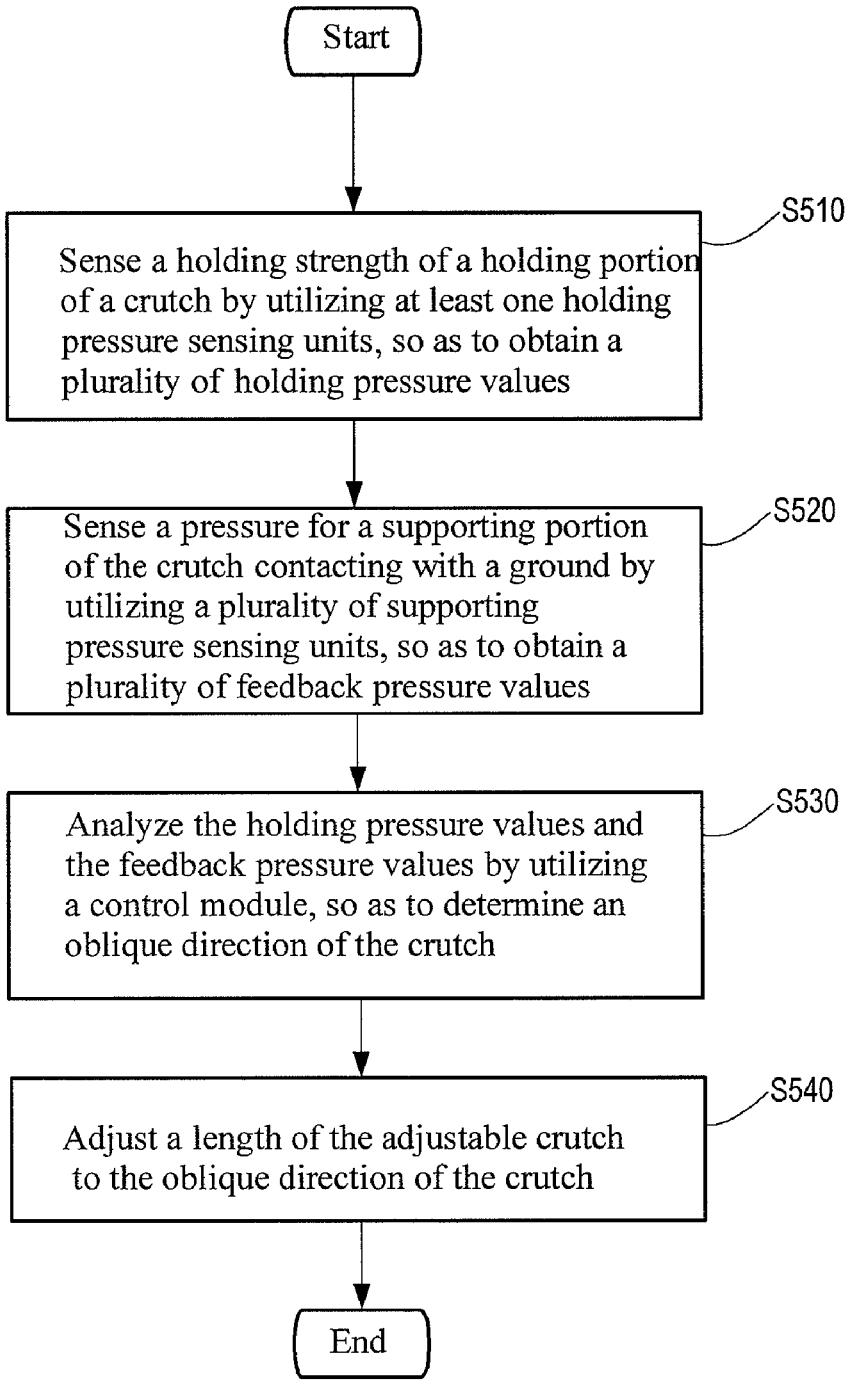
FIG. 5A is a flow chart of a crutch length controlling method by pressure sensing according to one embodiment of the present invention.

FIG. 5A is a flow chart of a length controlling method a crutch 3 by pressure sensing according to one embodiment of the present invention. For the sake of well understanding, please refer to FIGS. 5A, 2A, and 3 at the same time. The method includes the following steps.

A holding strength of a holding portion 31 of the crutch 3 is sensed by utilizing at least one holding pressure sensing units 32, so as to obtain at least one holding pressure value (Step S510). Each holding pressure sensing unit 32 senses the holding strength of the holding portion 31, so as to generate more than one holding pressure values, and the holding pressure values are transmitted to the control module 33.

A pressure for a supporting portion 36 of the crutch 3 contacting with the ground is sensed by utilizing a plurality of supporting pressure sensing units 38, so as to obtain a plurality of feedback pressure values (Step S520). Each supporting pressure sensing unit 38 is used to sense the pressure for the supporting portion 36 contacting with the ground, that is, when all the legs contact with the ground, the legs generate different stresses, the supporting pressure sensing units 38 sense the stresses, so as to generate the plurality of feedback pressure values, and the feedback pressure values are transmitted to the control module 33. For FIG. 2A, the supporting pressure sensing units 38 are respectively arranged on the front leg 361 and the rear leg 362. The feedback pressure values include the front feedback pressure value obtained when the front leg 361 leans against the ground obtain and the rear feedback pressure value obtained when the rear leg 362 leans against the ground.

Figure 5B:
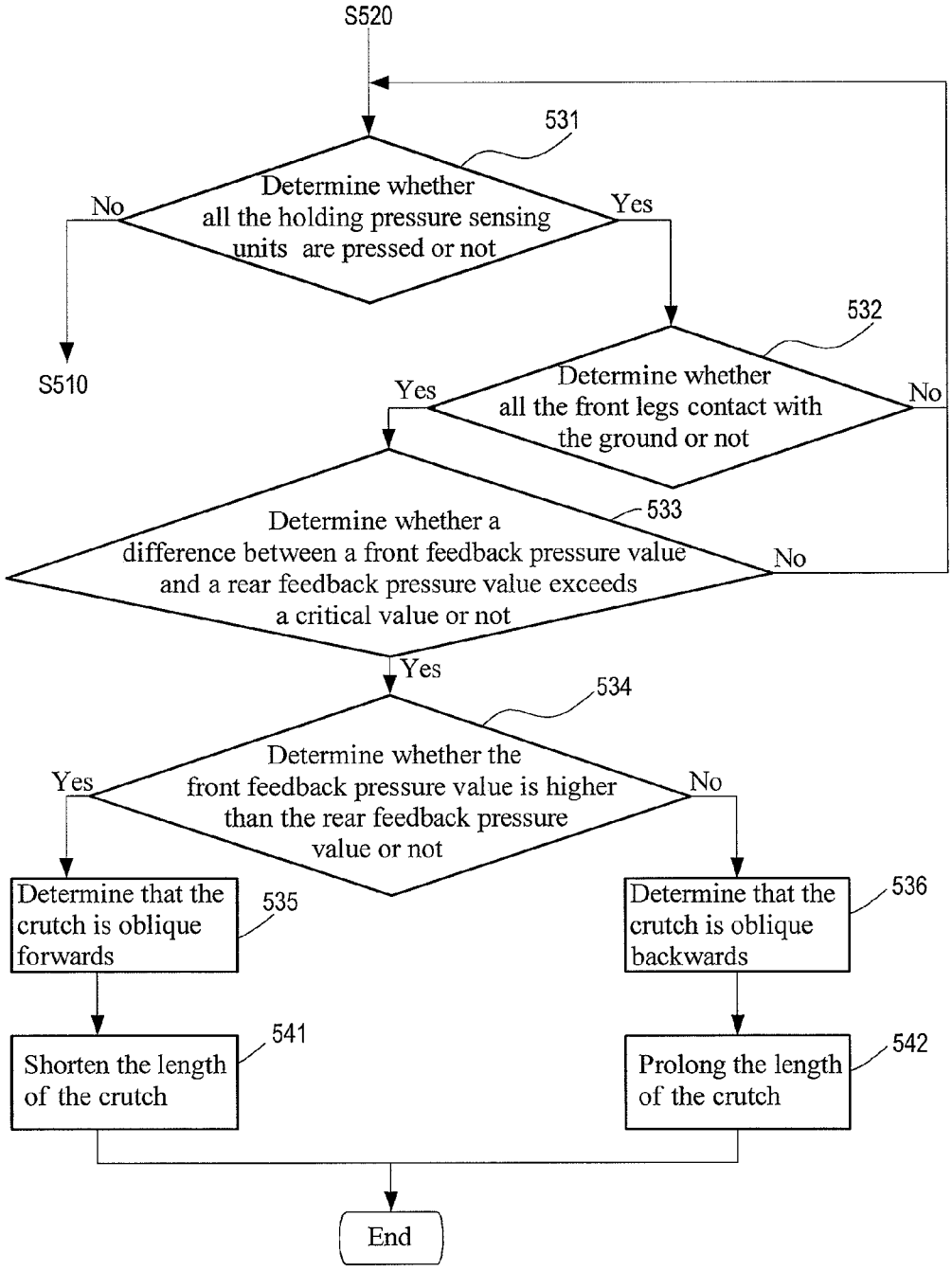
FIG. 5B is a detailed flow chart of the crutch length controlling method by pressure sensing according to one embodiment of the present invention.

The holding pressure values and the feedback pressure values are analyzed by utilizing a control module 33, so as to determine an oblique direction of the crutch 3 (Step S530). The step includes a plurality of detailed processes. FIG. 5B is a detailed flow chart of the length controlling method for the crutch 3 by pressure sensing according to one embodiment of the present invention. Referring to FIG. 5B, Step S530 includes the following sub-steps.

It is determined whether all the holding pressure sensing units 32 are pressed or not (Step S531). The holding pressure sensing units 32 are arranged on the holding portion 31, which may be covered when a user holds the holding portion 31. For FIG. 2A, the two holding pressure sensing units 32 are respectively arranged on a top and a bottom of the holding portion 31, a palm of the user contacts with the holding pressure sensing unit 32 on the top, and fingers of the user contact with the holding pressure sensing unit 32 on the bottom. The control module 33 determines whether each holding pressure sensing unit 32 is pressed or not by analyzing each holding pressure value, so as to determine whether the holding portion 31 is held or not.

When it is determined that not all the holding pressure sensing units 32 are pressed, it represents that the holding portion 31 is not held, and the process returns to Step S510, so as to obtain the holding pressure values again. When it is determined all the holding pressure sensing units 32 are pressed, it is determined whether all the front legs 361 and all the rear legs 362 contact with the ground or not according to the feedback pressure values (Step S532). The control module 33 determines whether all the supporting pressure sensing units 38 are pressed or not according to the feedback pressure values, so as to determine whether all the legs contact with the ground or not.

When it is determined that not all the legs contact with the ground, the process returns to Step S531, thereby determining whether the holding portion 31 is held again.

When it is determined that all the legs contact with the ground, it is determined whether the difference between the front feedback pressure value and the rear feedback pressure value exceeds a critical value or not (Step S533). The critical value is pre-stored in the control module 33 when the crutch 3 is designed.

When it is determined that the difference between the two feedback pressure values does not exceed the critical value, the control module 33 determines that the crutch 3 is not oblique, the control module 33 does not operate, or the process returns to Step S531, so as to determine whether the holding portion 31 is held or not again. When it is determined that the difference between the two feedback pressure values exceeds the critical value, the control module 33 determines whether the front feedback pressure value is higher than the rear feedback pressure value or not (Step S534). The control module 33 analyzes whether the strength for the front leg 361 contacting with the ground is larger than the strength for the rear leg 362 contacting with the ground or not, thereby determining whether the crutch 3 is oblique forwards or oblique backwards. When determining that the front feedback pressure value is higher than the rear feedback pressure value, the control module 33 determines that the crutch 3 is oblique forwards (Step S535), on the contrary, the control module 33 determines that the crutch 3 is oblique backwards (Step S536).

The length of the adjustable crutch 3 is adjusted according to the oblique direction of the crutch 3 (Step S540). The step may be performed in different ways according to a result generated in Step S530. When the crutch 3 is oblique forwards, the length of the crutch 3 is shortened (Step S541). The control module 33 controls the motor 37 to rotate to drive the lead screw shaft 35 to pivotally rotate. The supporting portion 36 cannot rotate under a resistance as all the legs contact the with ground, and the rod body 34 cannot pivotally rotate as the holding portion 31 is held by the user, so the lead screw shaft 35 is increasingly screwed into the rod body 34 as the lead screw shaft 35 pivotally rotates, such that the lead screw shaft 35 can pivotally rotate inward the rod body 34, thereby shortening the length of the crutch 3.

On the contrary, when the crutch 3 is oblique backwards, the length of the crutch 3 is prolonged (Step S542). The control module 33 controls the motor 37 to rotate, thereby drive the lead screw shaft 35 to pivotally rotate. The supporting portion 36 cannot rotate under a resistance as all the legs contact with the ground, and the rod body 34 cannot pivotally rotate as the holding portion 31 is held by the user, so the lead screw shaft 35 is increasingly screwed out from the rod body 34 as the lead screw shaft 35 pivotally rotates, such that the lead screw shaft 35 can pivotally rotate outward from the rod body 34, thereby prolonging the length of the crutch 3.

To sum up, implementation manners or embodiments of technical means adopted by the present invention are thus described, and are not used to limit the implementation scope of the present invention. It is intended that the present invention cover modifications and variations of this invention provided they fall within the scope of the following claims and their equivalents.

What is claimed is:

1. A crutch with a length controllable by pressure sensing, comprising:

a holding portion, having a holding pressure sensing unit, for generating a holding pressure value;

a lead screw shaft, comprising an engaging portion and a screwing portion on two ends of the lead screw shaft respectively;

a supporting portion, perpendicular to the lead screw shaft, and comprising:

a plurality of supporting pressure sensing units, for sensing a pressure for the supporting portion contacting with a ground, so as to generate a plurality of feedback pressure values;

a motor, engaged to the engaging portion to drive the lead screw shaft to pivotally rotate; and a rod body, having one end connected to the holding portion and an other end pivoted to the screwing portion of the lead screw shaft, and allowing the lead screw to pivotally rotate inward or outward from the rod body; and a control module, electrically coupled to the holding pressure sensing unit, the supporting pressure sensing units, and the motor, for controlling a rotation of the motor according to the holding pressure value and the feedback pressure values.

2. The crutch with a length controllable by pressure sensing according to claim 1, wherein the supporting portion comprises a front leg and a rear leg, the supporting pressure sensing units are respectively arranged on the front leg and the rear leg, and the feedback pressure values comprise a front feedback pressure value obtained when the front leg leans against the ground and a rear feedback pressure value obtained when the rear leg leans against the ground.

3. The crutch with a length controllable by pressure sensing according to claim 2, wherein when the control module determines that the front feedback pressure value is higher than the rear feedback pressure value, and that the holding pressure value is obtained, the control module enables the lead screw shaft to pivotally rotate inward the rod body, thereby shortening the length of the crutch; and when the control module determines that the front feedback pressure value is lower than the rear feedback pressure value, and that the holding pressure value is obtained, the control module enables the lead screw shaft to pivotally rotate outward from the rod body, thereby prolonging the length of the crutch.

4. The crutch with a length controllable by pressure sensing according to claim 1, wherein the control module is arranged on the holding portion, the rod body, or the supporting portion.

5. The crutch with a length controllable by pressure sensing according to claim 1, further comprising a level meter, wherein the level meter is electrically coupled to the control module so as to generate an oblique angle value, and the control module controls the rotation of the motor according to the holding pressure values, the feedback pressure values, and the oblique angle value.

6. The crutch with a length controllable by pressure sensing according to claim 5, wherein when the control module determines that the crutch is oblique forwards by analyzing the oblique angle value, the control module enables the lead screw shaft to pivotally rotate inward the rod body, thereby shortening the length of the crutch; and when the control module determines that the crutch is oblique backwards by analyzing the oblique angle value, the control module enables the lead screw shaft to pivotally rotate outward from the rod body, thereby prolonging the length of the crutch.

7. The crutch with a length controllable by pressure sensing according to claim 1, further comprising a sensitivity adjuster, for adjusting a pivotally-rotating unit of the lead screw shaft driven by the motor.

8. The crutch with a length controllable by pressure sensing according to claim 1, wherein the control module determines whether the supporting portion contacts with the ground or not by analyzing the feedback pressure values, and controls the rotation of the motor when it is determined that the supporting portion contacts with the ground.

* * * * *